US008342433B2

(12) United States Patent
Landis

(10) Patent No.: US 8,342,433 B2
(45) Date of Patent: Jan. 1, 2013

(54) APPARATUS AND METHOD FOR PROCESSING RECYCLABLE ASPHALT MATERIALS

(76) Inventor: Kevin C. Landis, Telford, PA (US)

( * ) Notice: Subject to any disclaimer, the term of this patent is extended or adjusted under 35 U.S.C. 154(b) by 224 days.

(21) Appl. No.: 12/902,893

(22) Filed: Oct. 12, 2010

(65) Prior Publication Data

US 2012/0085845 A1 Apr. 12, 2012

(51) Int. Cl.
*B02C 11/08* (2006.01)

(52) U.S. Cl. ..... 241/23; 241/67

(58) Field of Classification Search ..... 241/23, 241/67, 299

See application file for complete search history.

(56) References Cited

U.S. PATENT DOCUMENTS

| | | | |
|---|---|---|---|
| 1,000,267 | A | 8/1911 | Jackson |
| 2,057,099 | A | 10/1936 | Ingraham |
| 2,198,820 | A | 4/1940 | How |
| 2,715,517 | A | 8/1955 | Bojner |
| 4,106,110 | A | 8/1978 | Mendenhall |
| 4,265,031 | A | 5/1981 | Kirchhoff |
| 4,344,596 | A | 8/1982 | Hjaeresen |
| 4,427,376 | A | 1/1984 | Etnyre et al. |
| 4,477,984 | A | 10/1984 | Wenger |
| 4,600,379 | A | 7/1986 | Elliott |
| 4,612,711 | A | 9/1986 | Murray |
| 4,684,342 | A | 8/1987 | Harcuba |
| 5,188,299 | A | 2/1993 | Hendrickson et al. |
| 5,294,062 | A | 3/1994 | Hendrickson et al. |
| 5,520,342 | A | 5/1996 | Hendrickson et al. |
| 5,581,902 | A | 12/1996 | Didion et al. |
| 5,607,232 | A | 3/1997 | Dahl |
| 5,658,094 | A | 8/1997 | Clawson |
| 5,716,205 | A | 2/1998 | Tratz |
| 5,890,814 | A | 4/1999 | Catlett |
| 6,340,240 | B1 | 1/2002 | Swisher, Jr. et al. |
| 7,669,792 | B1 * | 3/2010 | Anderson et al. ..... 241/33 |

* cited by examiner

*Primary Examiner* — Faye Francis
(74) *Attorney, Agent, or Firm* — Arthur Jacob

(57) ABSTRACT

Apparatus and method are disclosed for processing recyclable asphalt material. A drum has a polygonal cross-sectional configuration providing a plurality of substantially flat wall sides. Tubular breaker members within the drum are juxtaposed with corresponding flat wall sides. The relative location of the breaker members and the flat wall sides effects a cascading of recyclable asphalt material over the breaker members and between the breaker members and the flat wall sides as the drum is rotated so that recyclable asphalt material is tumbled within the drum, thereby simultaneously reducing the size of relatively large pieces to aggregate-sized pieces and heating the mass containing the desired aggregate-sized pieces for delivery of the heated mass from the drum.

22 Claims, 3 Drawing Sheets

APPARATUS AND METHOD FOR PROCESSING RECYCLABLE ASPHALT MATERIALS

The present invention relates generally to the processing of asphalt materials and pertains, more specifically, to recycling existing asphalt pavement materials.

Asphalt has long been the material of choice for pavement and has found widespread use throughout the world in filling the need for more and more pavement. More recently, recycled asphalt products are being specified for use in an effort to conserve materials used in asphalt production. The use of recycled asphalt materials has become more important as existing pavement is reconditioned or replaced and the disposal of the old, replaced pavement material becomes more difficult and more costly. As a result, large amounts of old asphalt materials have become available for reuse.

In a series of earlier patents, there is described apparatus and methods for processing asphalt material to be recycled by introducing used asphalt material from the field in relatively large pieces, as received from the field, into a cage-like array of tubular breaker members within a drum while simultaneously heating the tubular breaker members and rotating the drum, with the cage-like array, about a tilted central axis of rotation to tumble the material within the cage-like array and drum and reduce the size of the pieces of material to a desired aggregate size within a mass of material moving along the cage-like array and drum. The tubular breaker members are spaced apart circumferentially such that only the desired aggregate-sized pieces in the mass of material pass radially out of the cage-like array for delivery and reuse. In this connection, reference is made to U.S. Pat. Nos. 5,188,299, 5,294,062 and 5,520,342 which disclose such apparatus and methods, the disclosures of which patents are incorporated herein by reference thereto.

The present invention provides improvements to the aforesaid apparatus and methods. These improvements attain several objects and advantages, some of which are summarized as follows: The drum includes a drum wall having an inner surface with a polygonal cross-sectional configuration that establishes a plurality of preferably flat drum wall sides which, together with the relative location of the cage-like array of tubular breaker members, provides improved agitation and enhanced conduction of heat for the transfer of heat to the recycled asphalt material being processed; the path of travel followed by heated gases through the array of tubular breaker members, and through an outer conduit extending along the drum wall to heat the inner surface of the drum wall, provides more effective conduction of heat to the material being processed within the drum; the arrangement of the heated array of tubular breaker members within the heated drum wall avoids exposure of the material to wide differences in temperature between the tubular breaker members and the surrounding drum wall as the material is processed within the drum, thereby attaining a more uniform heating of the material and avoiding deleterious consequences, such as the generation of unwanted pollutants and sticking of the material to the surrounding drum wall; the location of the cage-like array of tubular breaker members relative to the multiple drum wall sides serves to hold the material longer in position to receive heat conducted to the material and establishes a cascading of the recyclable asphalt material over the heated surfaces provided by the breaker members and the drum wall, resulting in more complete agitation and transfer of heat to the material being processed within the drum; the dimensions and location of a substantially central heat conduit provides for the radiation of additional heat to the material being processed within the drum; the arrangement of the tubular breaker members and the central heat conduit within the drum facilitates thermal expansion and contraction of these components during cycles of operation of the apparatus without undue stress upon these components, resulting in more reliable operation and increased longevity; the mounting of the drum for rotation about a longitudinal axis includes mounting couplings which accommodate diametric expansion and contraction of the drum wall to avoid excessive stress during operation of the apparatus.

The above objects and advantages, as well as further objects and advantages, are attained by the present invention which may be described briefly as apparatus for processing recyclable asphalt material received from the field in relatively large pieces for delivery in a heated mass containing desired smaller aggregate-sized pieces for reuse, the apparatus comprising: an elongate drum having a drum wall extending along a longitudinal axis between a first end and a second end, the drum wall having an inner surface following a polygonal lateral cross-sectional configuration establishing an inner chamber bounded by a plurality of wall sides extending between included angles; a mounting arrangement mounting the drum for rotation in a given direction of rotation about the longitudinal axis, with the longitudinal axis tilted at an acute angle so as to elevate one of the first and second ends relative to the other of the first and second ends; a heating chamber adjacent the first end of the drum, the heating chamber having an interior; a plurality of tubular breaker members extending along the drum between the first and second ends of the drum, the breaker members being placed in an array substantially parallel to the longitudinal axis, located between the longitudinal axis and the wall of the drum, each breaker member being spaced outwardly from the longitudinal axis and spaced inwardly from a corresponding wall side of the drum along a line extending in a lateral direction outwardly from the longitudinal axis and intersecting the corresponding side intermediate corresponding included angles; a heat conduit extending along the drum between the first and second ends of the drum, the heat conduit being located within the array of breaker members, spaced laterally inwardly from the array; a heater for supplying heat to heat gases in the interior of the heating chamber; the interior of the heating chamber, the heat conduit and the breaker members being connected serially such that heated gases from the interior of the heating chamber are conducted from adjacent the first end of the drum to adjacent the second end of the drum and are returned to adjacent the first end of the drum serially through the heat conduit and then through the breaker members; a feeder for feeding the large pieces of recyclable asphalt material received from the field into the array of breaker members within the drum, adjacent the elevated one of the first and second ends of the drum; and a drive arrangement for rotating the drum, and the array of breaker members about the longitudinal axis so as to tumble the large pieces of recyclable asphalt material within the drum, spaced laterally outwardly from the heat conduit and cascaded over the breaker members to be passed between adjacent breaker members and between the breaker members and the corresponding wall sides of the drum wall, thereby simultaneously reducing the size of the relatively large pieces to the desired aggregate-sized pieces and heating the mass containing the desired aggregate-sized pieces, which heated mass proceeds toward the other of the first and second ends of the drum for delivery from the drum.

In addition, the present invention includes, in an apparatus for processing recyclable asphalt material received from the field in relatively large pieces for delivery in a heated mass containing desired smaller aggregate-sized pieces for reuse in a drum mounted by a mounting arrangement for rotation in a given direction of rotation about a longitudinal axis, the improvement wherein the mounting arrangement comprises: at least one mounting ring placed coaxial with the longitudinal axis and spaced from the drum by a radial spacing; support rollers supporting the mounting ring for rotation about the longitudinal axis; and couplings coupling the drum with the mounting ring, each coupling including a substantially rigid link having first and second link ends, the first link end being coupled to the drum for pivotal movement relative to the drum, and the second link end being coupled to the mounting ring for pivotal movement relative to the mounting ring, the first and second link ends being offset circumferentially relative to one another by an offset angle such that the link is movable to vary the radial spacing in response to thermal expansion and contraction of the drum relative to the mounting ring.

Further, the present invention provides a method for processing recyclable asphalt material received from the field in relatively large pieces for delivery in a heated mass containing desired smaller aggregate-sized pieces for reuse, the method comprising: providing an elongate drum having a drum wall extending along a longitudinal axis between a first end and a second end, the drum wall having an inner surface following a polygonal lateral cross-sectional configuration establishing an inner chamber bounded by a plurality of wall sides extending between included angles; mounting the drum for rotation in a given direction of rotation about the longitudinal axis, with the longitudinal axis tilted at an acute angle so as to elevate one of the first and second ends relative to the other of the first and second ends; providing a plurality of tubular breaker members extending along the drum between the first and second ends of the drum, the breaker members being placed in an array substantially parallel to the longitudinal axis, located between the longitudinal axis and the wall of the drum, each breaker member being spaced outwardly from the longitudinal axis and spaced inwardly from a corresponding wall side of the drum along a line extending in a lateral direction outwardly from the longitudinal axis and intersecting the corresponding side intermediate corresponding included angles; conducting heated gases along a path of travel through the breaker members; feeding the large pieces of recyclable asphalt material received from the field into the array of breaker members within the drum, adjacent the elevated one of the first and second ends of the drum; and rotating the drum, and the array of breaker members about the longitudinal axis so as to tumble the large pieces of recyclable asphalt material within the drum and cascade the recyclable asphalt material over the breaker members and pass the recyclable asphalt material between adjacent breaker members and between the breaker members and the corresponding wall sides of the drum wall, thereby simultaneously reducing the size of the relatively large pieces to the desired aggregate-sized pieces and heating the heated mass containing the desired aggregate-sized pieces, which mass proceeds toward the other of the first and second ends of the drum for delivery from the drum.

The invention will be understood more fully, while still further objects and advantages will become apparent, in the following detailed description of preferred embodiments of the invention illustrated in the accompanying drawing, in which.

Figure 1:
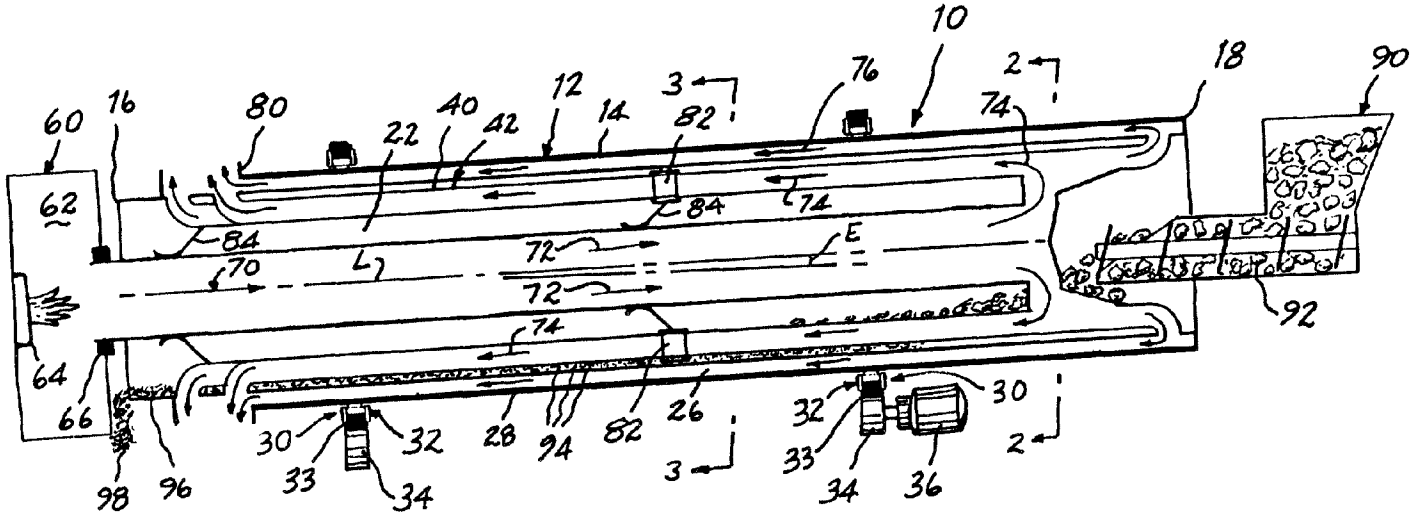
FIG. 1 is a largely diagrammatic and somewhat schematic longitudinal cross-sectional view illustrating an apparatus and method of the present invention.
Figure 2:
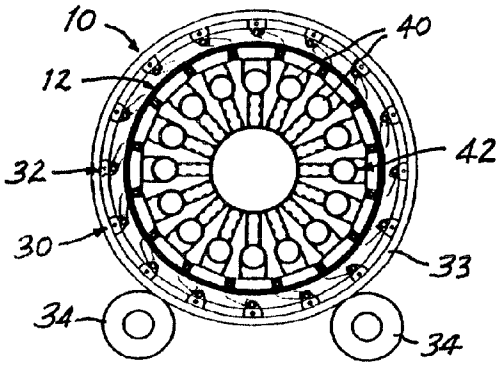
FIG. 2 is a cross-sectional view taken along line 2-2 of FIG. 1.

Referring now to the drawing, an apparatus constructed in accordance with the present invention is shown largely diagrammatically at 10 and is depicted in operation in accordance with a method of the present invention. Apparatus 10 includes an elongate drum 12 having a drum wall 14 extending along a longitudinal axis L between a first end 16 and a second end 18. Drum wall 14 includes an inner wall 19 with an inner surface 20 having a substantially polygonal lateral cross-sectional configuration establishing an inner chamber 22 bounded by a plurality of wall sides 24, each wall side 24 preferably being flat and extending between included angles A. Drum wall 14 includes an outer wall 25 spaced radially outwardly from the inner wall 19 to establish an outer conduit 26, between the inner wall 19 and the outer wall 25, and a layer 28 of heat insulating material surrounds the outer wall 25, all for purposes to be described more fully below.

As is now conventional in apparatus for processing recyclable asphalt material, drum 12 is mounted for rotation about longitudinal axis L, with axis L tilted an a shallow acute angle E so as to elevate second end 18 relative to first end 16. To that end, a pair of mounting arrangements 30 are spaced longitudinally from one another along drum 12, and each mounting arrangement includes a plurality of mounting couplings 32 attached to and spaced circumferentially around drum 12 for coupling drum 12 with counterpart circumferential mounting rings, each in the form of a tire 33 which, in turn, is supported upon a pair of rollers 34, all in a manner set forth in greater detail below. A drive arrangement includes a motor drive 36 coupled to at least one of the rollers 34 for rotating the drum 12 about axis L.

A plurality of tubular breaker members 40 extend along the drum 12, within inner chamber 22, longitudinally between the first end 16 and the second end 18 of the drum 12, the breaker members 40 being placed in an array 42 extending generally parallel to the longitudinal axis L and located between the longitudinal axis L and the inner surface 20 of the drum wall 14. Each breaker member 40 has an interior 44, is spaced outwardly from the longitudinal axis L and is spaced inwardly from a corresponding wall side 24 of the drum 12 along a line R extending in a radial direction laterally outwardly from longitudinal axis L and intersecting the corresponding wall side 24 intermediate, and preferably substantially midway between, corresponding included angles A. In the preferred configuration, each breaker member 40 has a circular cross-sectional configuration of predetermined diameter D, providing a substantially cylindrical exterior surface 46 with a prescribed surface area.

A heat conduit 50 extends along the drum 12 between the first end 16 and the second end 18 of the drum 12 and is located within the array 42 of breaker members 40, spaced laterally inwardly from the array 42, preferably centered within the array 42. Heat conduit 50 has an interior 52 and, in the preferred configuration, includes a circular cross-sectional configuration of predetermined diameter DD. Diameter DD is greater than diameter D of a breaker member 40 and provides a substantially cylindrical exterior surface 56 with a prescribed surface area substantially greater than the surface area of the exterior surface 46 of a breaker member 40. A heating chamber 60 is placed adjacent the first end 16 of the drum 12 and has an interior 62, the heating chamber 60 being located such that the interior 62 of the heating chamber 60 communicates with the interior 52 of the heat conduit 50. A heater is shown in the form of a burner 64 placed within the interior 62 of heating chamber 60, and heat from the burner 64 supplies heat to the interior 62 of the heating chamber 60 so that heated gases are passed from the interior 62 of the heating chamber 60 to the interior 52 of the heat conduit 50. The interior 62 of the heating chamber 60 is isolated from the interior of the inner chamber 22 of the drum 12, as by a seal 66.

The interior 62 of the heating chamber 60 and the interior 52 of the heat conduit 50 are connected serially, and the interior 44 of each breaker member 40 is connected serially with the interior 52 of the heat conduit 50 such that the heated gasses generated within the heating chamber 60 flow along a path of travel 70 through the heat conduit 50, in the direction from the first end 16 toward the second end 18 of the drum 12, as illustrated by arrows 72, and then into the array 42 of breaker members 40 to flow in the direction from the second end 18 toward the first end 16, as illustrated by arrows 74. At the same time, heated gasses are directed into the outer conduit 26 to flow in the direction from the second end 18 toward the first end 16, as illustrated by arrows 76. The heated gasses are exhausted through an exhaust manifold 80 located adjacent the first end 16 of the drum 12.

The array 42 is supported within inner chamber 22 by supports 82 which are affixed to drum wall 14 of drum 12 at inner wall 19 to position the array 42 radially relative to drum wall 14 while allowing sliding movement of array 42 in longitudinal directions relative to each support 82 in response to thermal expansion and contraction of breaker members 40 during cycles of operation of apparatus 10. Supplemental supports 84 support heat conduit 50 radially relative to drum wall 14 and array 42, while enabling longitudinal sliding movement of heat conduit 50 relative to both the drum wall 14 and the array 42 in response to thermal expansion and contraction. In this manner, excessive stresses within these components are avoided during cycles of heating and cooling, resulting in greater reliability and increased longevity.

During operation of apparatus 10, a feeder 90 feeds large pieces 92 of recyclable asphalt material received from the field into drum 12, adjacent elevated second end 18 of the drum 12, as illustrated diagrammatically in FIG. 1. The drum 12 is rotated, and heated gases are circulated through the heat conduit 50, the breaker members 40, and the outer conduit 26, while the large pieces 92 are tumbled within the inner chamber 22, spaced radially outwardly from the heat conduit 50 and engaged by the breaker members 40 to reduce the size of the relatively large pieces 92 to desired aggregate-sized pieces 94 within a heated mass 96 containing the desired aggregate-sized pieces 94, which heated mass 96 proceeds toward first end 16 of drum 12 to be delivered from the drum 12 at a downstream delivery location 98.

Figure 3:
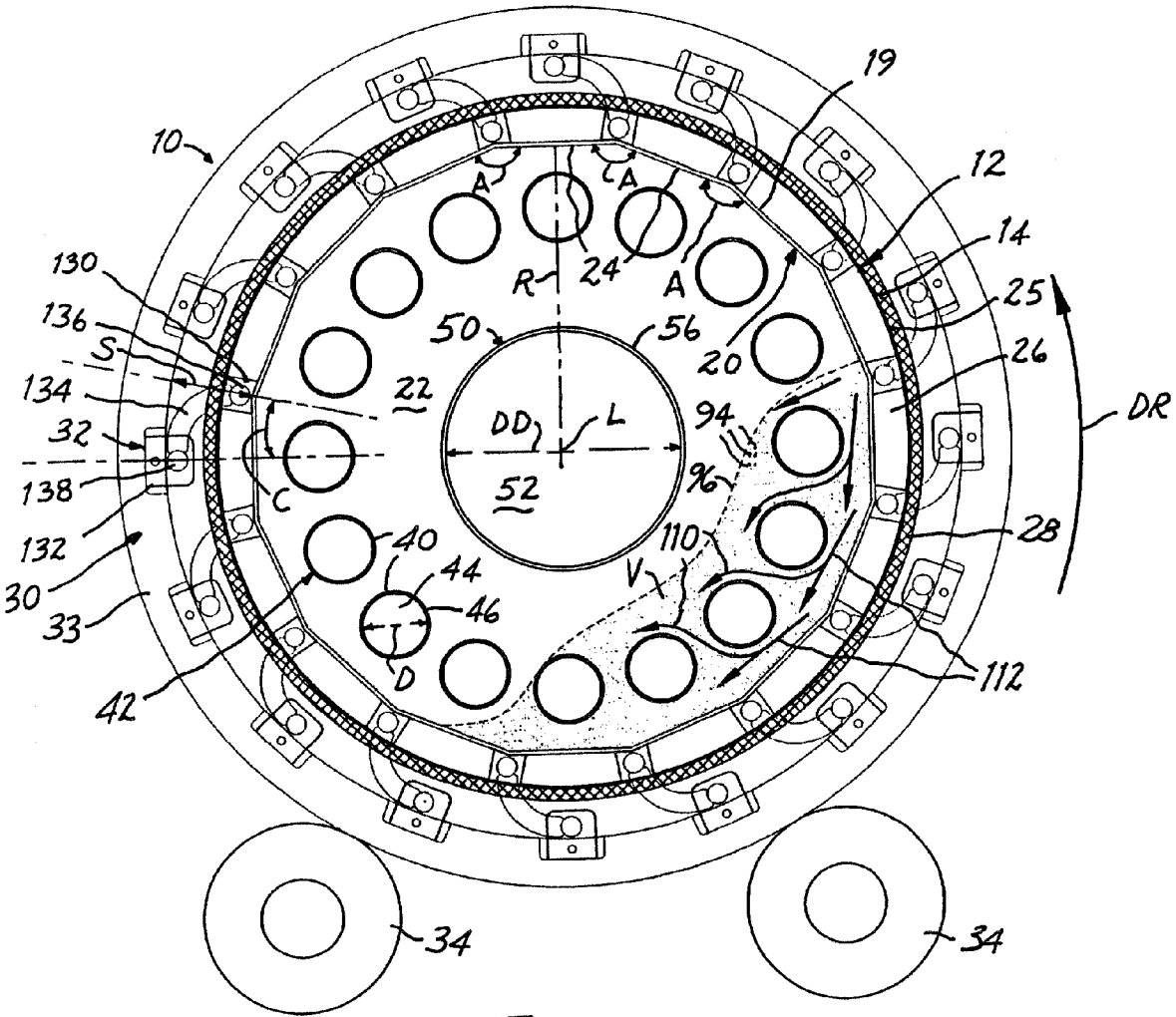
FIG. 3 is an enlarged cross-sectional view taken along line 3-3 of FIG. 1.

As best seen in FIG. 3, the placement relative to one-another of the round breaker members 40 provided by array 42, and the flat wall sides 24 provided by the polygonal cross-sectional configuration of the inner surface 20, enables the array 42 and the flat wall sides 24 to act in concert to hold the material longer in position to effect an extended dwell time during which heat is conducted to the mass 96. In addition, as the drum rotates about axis L, a cascading of the mass 96 over the breaker members 40 and passing between adjacent breaker members 40, as illustrated by arrows 110, as well as a slowed movement of the mass 96 between the breaker members 40 and the flat wall sides 24, as illustrated by arrows 112, effected by the configuration of the exterior surface 46 of each breaker member 40 and the configuration of the flat wall sides 24 provided by the polygonal cross-sectional configuration of the inner wall 19 of wall 14 of the drum 12 acting in concert not only to expose the material of mass 96 to increased conduction of heat from exterior surface 46 to the material, but increasing agitation of the mass 96 for a simultaneous reduction in size of the relatively large pieces 92 as well as enhanced heating of the mass 96. At the same time, the mass 96 is maintained within an optimum volume V, spaced from the heat conduit 50 so as to receive radiant heat from the relatively large exterior surface 56 of the heat conduit 50 while heat is conducted to the mass 96 from the breaker members 40. The diameter DD of heat conduit 50 can be considerably larger than diameter D of breaker members 40, thereby providing exterior surface 56 with a relatively large area for radiating heat to the mass 96. Further, inner wall 20 is heated by the heated gasses flowing through outer conduit 26, assuring that the surfaces contacted by the material being processed within the drum 12 are heated so as to avoid exposure of the material to wide variations in temperature at those surfaces and concomitant deleterious effects such as the generation of excessive smoke and particulates, as well as pollutants, and sticking of the material to the surfaces contacted by the material, which sticking could result from contact with unheated or relatively cooler surfaces.

Isolation of the interior 62 of the heating chamber 60 from the interior of inner chamber 22 of the drum 12 assures that the material being processed within the inner chamber 22 is not exposed to an open flame of burner 64, thus avoiding ignition of any material within the inner chamber 22. Isolation of the interior 52 of heat conduit 50 from the inner chamber 22 of drum 12 further enables larger volumes of heated gasses to be passed from the heating chamber 60 at higher temperatures and higher velocities without deleterious effects upon the material being processed within inner chamber 22, facilitating the adjustment and control of temperatures along the path of travel 70 of the heated gasses and enabling more efficient heating of the material being processed. Further, isolation of the heated gasses from the material being processed in drum 12, throughout the entire length of the path of travel 70 of the heated gasses from the heating chamber 60 to the exhaust manifold 80 allows better control of air within the inner chamber 22 with concomitant better control over the handling of any smoke, dust or other air-borne particulates within the inner chamber 22.

Turning now to the mounting arrangement 30, each mounting coupling 32 is seen to include a mounting pad 130 affixed to the inner wall 19 of the drum wall 14 of drum 12, and a mounting bracket 132 affixed to a corresponding tire 33 and offset circumferentially from a counterpart mounting pad 130, preferably in the direction of rotation DR of the drum 12, as illustrated in FIG. 3 by offset angle C. A substantially rigid link 134 spans the radial spacing S between the drum wall 14 and the tire 33 and interconnects each mounting pad 130 with a corresponding mounting bracket 132. Each link 134 is journaled at link end 136 for pivotal movement relative to mounting pad 130, and at link end 138 for pivotal movement relative to mounting bracket 132. In the preferred configuration, each link 134 follows a curved configuration between link ends 136 and 138. Upon thermal expansion and contraction of drum 12 in radial directions, and especially inner wall 19, during cycles of operation of apparatus 10, links 134 will pivot to compensate for changes in radial spacing S between the drum wall 14 and tire 33 while the circular configuration of tire 33 remains undistorted, and with the tire 33 in optimum engagement with rollers 34.

Figure 4:
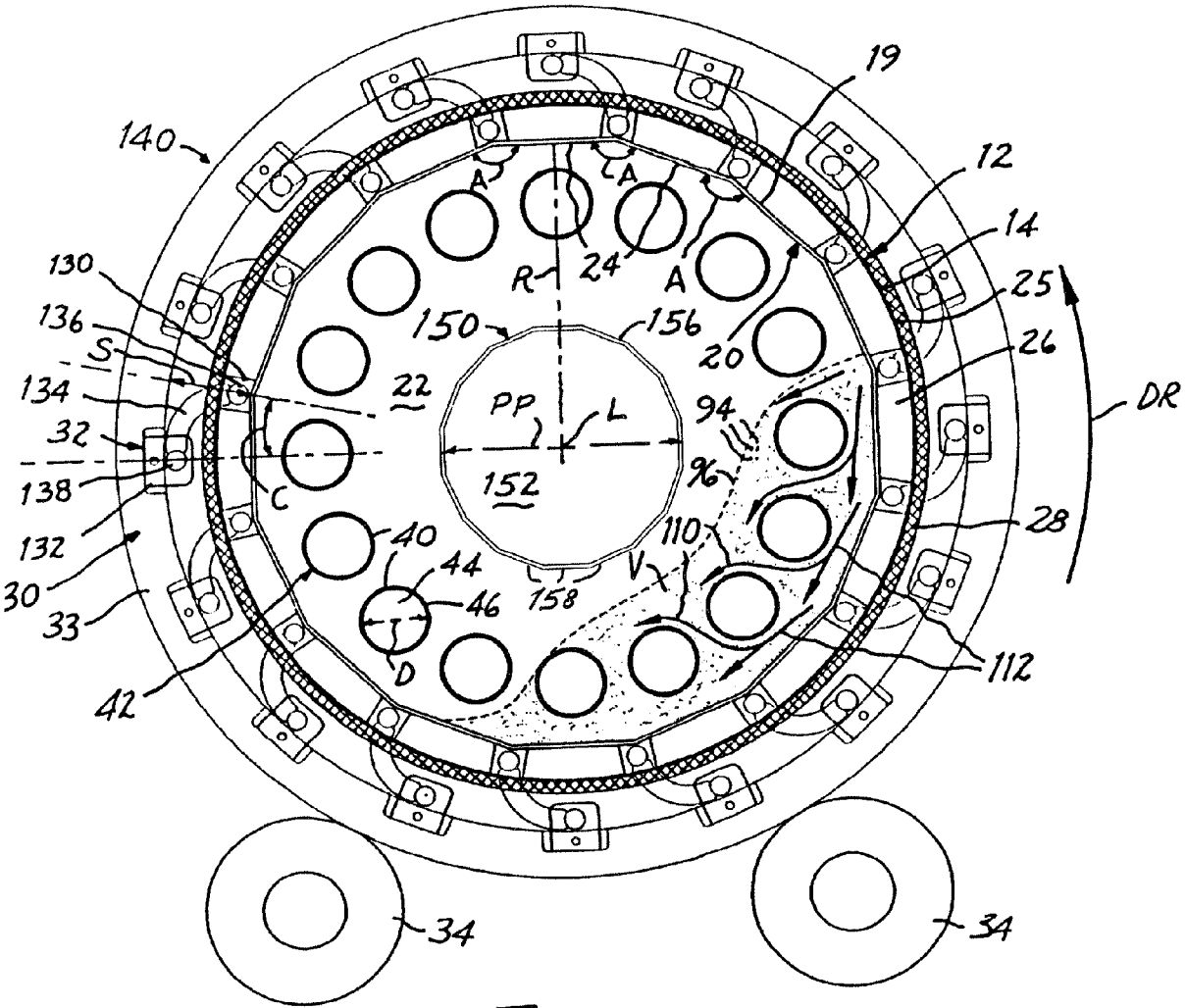
FIG. 4 is a cross-sectional view similar to FIG. 3 and illustrating another embodiment of the invention.

Referring now to FIG. 4, another embodiment of the present invention is illustrated in the form of an apparatus 140 constructed in accordance with the present invention and shown in a cross-sectional view similar to that of FIG. 3, and the same reference characters are utilized in FIG. 4 to identify component parts similar to those identified in the embodiment of FIG. 3. As in the earlier described embodiment, apparatus 140 includes a heat conduit 150 that extends along drum 12 between the first end 16 and the second end 18 of the drum 12, has an interior 152, and is located within the array 42 of breaker members 40, spaced laterally inwardly from the array 42, preferably centered within the array 42. However, heat conduit 150 includes a polygonal lateral cross-sectional configuration of a predetermined circumscribed diameter PP. Diameter PP is greater than diameter D of a breaker member 40 and provides an exterior surface 156 of polygonal lateral cross-sectional configuration with a prescribed surface area substantially greater than the surface area of the exterior surface 46 of a breaker member 40. In the preferred construction, the exterior surface 156 includes a plurality of exterior sides 158, the number of exterior sides 158 is equal to the number of wall sides 24, and the heat conduit 150 is aligned with the inner wall 19 of drum 12 such that each exterior side 158 confronts a corresponding wall side 24 and extends laterally, that is, within the plane of the paper, substantially parallel to the corresponding wall side 24, as shown.

As before, the interior 62 of the heating chamber 60 communicates with the interior 152 of the heat conduit 150, and heat from the burner 64 supplies heat to the interior 62 of the heating chamber 60 so that heated gases are passed from the interior 62 of the heating chamber 60 to the interior 152 of the heat conduit 150. The polygonal lateral cross-sectional configuration of the exterior surface 156, together with the orientation of the heat conduit 150 relative to the inner wall 19 of drum 12 enhances radiation of heat from exterior surface 156 to the mass 96 as the mass 96 proceeds downstream within the drum 12.

It will be seen that the present invention attains all of the objects and advantages summarized above, namely: The drum includes a drum wall having an inner surface with a polygonal cross-sectional configuration that establishes a plurality of preferably flat drum wall sides which, together with the relative location of the cage-like array of tubular breaker members, provides improved agitation and enhanced conduction of heat for the transfer of heat to the recycled asphalt material being processed; the path of travel followed by heated gases through the array of tubular breaker members, and through an outer conduit extending along the drum wall to heat the inner surface of the drum wall, provides more effective conduction of heat to the material being processed within the drum; the arrangement of the heated array of tubular breaker members within the heated drum wall avoids exposure of the material to wide differences in temperature between the tubular breaker members and the surrounding drum wall as the material is processed within the drum, thereby attaining a more uniform heating of the material and avoiding deleterious consequences, such as the generation of unwanted pollutants and sticking of the material to the surrounding drum wall; the location of the cage-like array of tubular breaker members relative to the multiple drum wall sides serves to hold the material longer in position to receive heat conducted to the material and establishes a cascading of the recyclable asphalt material over the heated surfaces provided by the breaker members and the drum wall, resulting in more complete agitation and transfer of heat to the material being processed within the drum; the dimensions and location of a substantially central heat conduit provides for the radiation of additional heat to the material being processed within the drum; the arrangement of the tubular breaker members and the central heat conduit within the drum facilitates thermal expansion and contraction of these components during cycles of operation of the apparatus without undue stress upon these components, resulting in more reliable operation and increased longevity; the mounting of the drum for rotation about a longitudinal axis includes mounting couplings which accommodate diametric expansion and contraction of the drum wall to avoid excessive stress during operation of the apparatus.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for processing recyclable asphalt material received from the field in relatively large pieces for delivery in a heated mass containing desired smaller aggregate-sized pieces for reuse, the apparatus comprising:

an elongate drum having a drum wall extending along a longitudinal axis between a first end and a second end, the drum wall having an inner surface following a polygonal lateral cross-sectional configuration establishing an inner chamber bounded by a plurality of wall sides extending between included angles;

a mounting arrangement mounting the drum for rotation in a given direction of rotation about the longitudinal axis, with the longitudinal axis tilted at an acute angle so as to elevate one of the first and second ends relative to the other of the first and second ends;

a heating chamber adjacent the first end of the drum, the heating chamber having an interior;

a plurality of tubular breaker members extending along the drum between the first and second ends of the drum, the breaker members being placed in an array substantially parallel to the longitudinal axis, located between the longitudinal axis and the wall of the drum, each breaker member being spaced outwardly from the longitudinal axis and spaced inwardly from a corresponding wall side of the drum along a line extending in a lateral direction outwardly from the longitudinal axis and intersecting the corresponding side intermediate corresponding included angles;

a heat conduit extending along the drum between the first and second ends of the drum, the heat conduit being located within the array of breaker members, spaced laterally inwardly from the array;

a heater for supplying heat to heat gases in the interior of the heating chamber;

the interior of the heating chamber, the heat conduit and the breaker members being connected serially such that heated gases from the interior of the heating chamber are conducted from adjacent the first end of the drum to adjacent the second end of the drum and are returned to adjacent the first end of the drum serially through the heat conduit and then through the breaker members;

a feeder for feeding the large pieces of recyclable asphalt material received from the field into the array of breaker members within the drum, adjacent the elevated one of the first and second ends of the drum; and a drive arrangement for rotating the drum, and the array of breaker members about the longitudinal axis so as to tumble the large pieces of recyclable asphalt material within the drum, spaced laterally outwardly from the heat conduit and cascaded over the breaker members to be passed between adjacent breaker members and between the breaker members and the corresponding wall sides of the drum wall, thereby simultaneously reducing the size of the relatively large pieces to the desired aggregate-sized pieces and heating the mass containing the desired aggregate-sized pieces, which heated mass proceeds toward the other of the first and second ends of the drum for delivery from the drum.

2. The apparatus of claim 1 wherein each wall side is substantially flat.

3. The apparatus of claim 1 wherein each laterally extending line intersects a corresponding wall side substantially midway between the corresponding included angles to place each breaker member substantially equidistant from each corresponding included angle.

4. The apparatus of claim 3 wherein the array of breaker members includes a breaker member placed adjacent each wall side.

5. The apparatus of claim 4 wherein the longitudinal axis extends centrally along the drum and each laterally extending line comprises a radius extending from the longitudinal axis to the drum wall.

6. The apparatus of claim 5 wherein each wall side is substantially flat.

7. The apparatus of claim 6 wherein the heat conduit includes an exterior heat conduit surface having a prescribed surface area, each breaker member includes an exterior breaker member surface having a predetermined surface area, and the outer heat conduit prescribed surface area is substantially greater than each exterior breaker member predetermined surface area.

8. The apparatus of claim 7 wherein the exterior breaker member surface of each breaker member follows a circular lateral cross-sectional configuration.

9. The apparatus of claim 8 wherein the exterior heat conduit surface of the heat conduit follows a circular lateral cross-sectional configuration.

10. The apparatus of claim 7 wherein the exterior heat conduit surface of the heat conduit follows a circular lateral cross-sectional configuration.

11. The apparatus of claim 7 wherein the heat conduit surface of the heat conduit follows a polygonal lateral cross-sectional configuration.

12. The apparatus of claim 11 wherein the plurality of wall sides bounding the inner chamber of the drum includes a prescribed number of wall sides, and the heat conduit surface includes a predetermined number of external sides, the predetermined number of external sides being equal to the prescribed number of wall sides.

13. The apparatus of claim 12 wherein the external sides are substantially flat, and each external side confronts a corresponding wall side and extends laterally substantially parallel to the corresponding wall side.

14. The apparatus of claim 1 including an outer conduit extending along the drum wall outside the inner chamber, the outer conduit being juxtaposed with corresponding wall sides and communicating with the heat conduit adjacent the second end of the drum for conducting heated gases from the heat conduit along the drum wall toward the first end of the drum.

15. The apparatus of claim 1 wherein the mounting arrangement includes:

at least one mounting ring placed coaxial with the longitudinal axis and spaced from the drum by a radial spacing;

support rollers supporting the mounting ring for rotation about the longitudinal axis; and couplings coupling the drum with the mounting ring, each coupling including a substantially rigid link having first and second link ends, the first link end being coupled to the drum for pivotal movement relative to the drum, and the second link end being coupled to the mounting ring for pivotal movement relative to the mounting ring, the first and second link ends being offset circumferentially relative to one another by an offset angle such that the link is movable to vary the radial spacing in response to thermal expansion and contraction of the drum relative to the mounting ring.

16. The apparatus of claim 15 wherein the offset angle places the first link end circumferentially behind the second link end with respect to the given direction of rotation.

17. A method for processing recyclable asphalt material received from the field in relatively large pieces for delivery in a heated mass containing desired smaller aggregate-sized pieces for reuse, the method comprising:

providing an elongate drum having a drum wall extending along a longitudinal axis between a first end and a second end, the drum wall having an inner surface following a polygonal lateral cross-sectional configuration establishing an inner chamber bounded by a plurality of wall sides extending between included angles;

mounting the drum for rotation in a given direction of rotation about the longitudinal axis, with the longitudinal axis tilted at an acute angle so as to elevate one of the first and second ends relative to the other of the first and second ends;

providing a plurality of tubular breaker members extending along the drum between the first and second ends of the drum, the breaker members being placed in an array substantially parallel to the longitudinal axis, located between the longitudinal axis and the wall of the drum, each breaker member being spaced outwardly from the longitudinal axis and spaced inwardly from a corresponding wall side of the drum along a line extending in a lateral direction outwardly from the longitudinal axis and intersecting the corresponding side intermediate corresponding included angles;

conducting heated gases along a path of travel through the breaker members;

feeding the large pieces of recyclable asphalt material received from the field into the array of breaker members within the drum, adjacent the elevated one of the first and second ends of the drum; and rotating the drum, and the array of breaker members about the longitudinal axis so as to tumble the large pieces of recyclable asphalt material within the drum and cascade the recyclable asphalt material over the breaker members and pass the recyclable asphalt material between adjacent breaker members and between the breaker members and the corresponding wall sides of the drum wall, thereby simultaneously reducing the size of the relatively large pieces to the desired aggregate-sized pieces and heating the heated mass containing the desired aggregate-sized pieces, which mass proceeds toward the other of the first and second ends of the drum for delivery from the drum.

18. The method of claim 17 including locating each breaker member such that each laterally extending line intersects a corresponding wall side substantially midway between the corresponding included angles to place each breaker member substantially equidistant from each corresponding included angle.

19. The method of claim 18 including placing a breaker member adjacent each wall side.

20. The method of claim 17 including mounting the drum such that the longitudinal axis extends centrally along the drum and each laterally extending line comprises a radius extending from the longitudinal axis to the drum wall.

21. The method of claim 17 including locating a heat conduit within the array of breaker members, spaced laterally inwardly from the array and extending along the drum between the first and second ends of the drum, such that the heated gases are passed serially through the heat conduit in a direction from the first end of the drum toward the second end of the drum to radiate heat from the heat conduit to the recyclable asphalt material, and then through the array of breaker members in a direction from the second end of the drum toward the first end of the drum to conduct heat from the breaker members to the recyclable asphalt material.

22. The method of claim 21 including providing an outer conduit extending along the drum wall outside the inner chamber, in juxtaposition with corresponding wall sides, and communicating with the heat conduit adjacent the second end of the drum, and passing heated gases from the heat conduit through the outer conduit in the direction from the second end of the drum toward the first end of the drum to conduct heat from the outer conduit to the recyclable asphalt material.

* * * * *